US005582962A

United States Patent [19]

Taguchi

[11] Patent Number: 5,582,962

[45] Date of Patent: Dec. 10, 1996

[54] SILVER HALIDE PHOTOGRAPHIC LIGHT-SENSITIVE MATERIAL AND THE PROCESSING METHOD THEREOF

[75] Inventor: Masaaki Taguchi, Hino, Japan

[73] Assignee: Konica Corporation, Japan

[21] Appl. No.: 425,815

[22] Filed: Apr. 19, 1995

[30] Foreign Application Priority Data

Apr. 25, 1994 [JP] Japan ..... 6-086592

[51] Int. Cl.[6] ..... G03C 1/815; G03C 1/83

[52] U.S. Cl. ..... 430/522; 430/559; 430/638; 430/966

[58] Field of Search ..... 430/966, 559, 430/593, 522, 638

[56] References Cited

U.S. PATENT DOCUMENTS

| | | | |
|---|---|---|---|
| 2,960,404 | 11/1960 | Milton et al. | 430/638 |
| 5,098,818 | 3/1992 | Ito et al. | 430/966 |
| 5,173,396 | 12/1992 | Nagasaki et al. | 430/529 |

FOREIGN PATENT DOCUMENTS

| | | | |
|---|---|---|---|
| 0321948 | 6/1989 | European Pat. Off. | 430/966 |
| 0264936 | 10/1990 | Japan | 430/966 |
| 3005748 | 1/1991 | Japan | 430/966 |

*Primary Examiner*—Lee C. Wright
*Attorney, Agent, or Firm*—Jordan B. Bierman; Bierman and Muserlian

[57] ABSTRACT

A silver halide photographic light-sensitive material is disclosed, comprising a support having on one side thereof hydrophilic colloid layers including a silver halide emulsion layer, wherein at least one of the hydrophilic colloid layers contains a dye represented by the following formula (1)

Formula (1)

wherein $R_1$ is a hydrogen atom, an alkyl group, an aryl group or a heterocyclic group; $R_2$ is a hydrogen atom, an alkyl group, an aryl group, a heterocyclic group, an alkoxycarbonyl group, an aryloxycarbonyl group, a carbamoyl group, an acylamino group, a ureido group, an amino group, an acyl group, an alkoxy group, an aryloxy group, a hydroxy group, a carboxy group, a cyano group, a sulfamoyl group or a sulfonamide group; B is a five- or six-membered oxygen-containing heterocyclic group, or a six-membered nitrogen-containing heterocyclic group; $L_1$, $L_2$ and $L_3$ are carbon atoms; n is 0 or 1, provided that the compound represented by formula (1) contains at least one of a carboxy group, a sulfonamide group, and a sulfamoyl group in the form of a dispersion of solid particles dispersed in a binder; the silver halide emulsion layer containing a polyhydric alcohol.

4 Claims, No Drawings

SILVER HALIDE PHOTOGRAPHIC LIGHT-SENSITIVE MATERIAL AND THE PROCESSING METHOD THEREOF

FIELD OF THE INVENTION

This invention relates to a silver halide photographic light-sensitive material and the processing method thereof and, particularly, to a silver halide photographic light-sensitive material having a high sensitivity, a high sharpness and a super-rapid processing aptitude and the processing method thereof.

DESCRIPTION OF THE PRIOR ART

A silver halide photographic light-sensitive material have been used widely, because a highly sensitive and sharp image can be obtained therefrom. The fields applicable therewith include, for example, an X-ray photographic field. An image of the structure of a patient's tissue and bone can be obtained by exposing a patient to X-rays and then by exposing to the transmitted light a photographic light-sensitive material comprising a blue-tinted transparent support coated thereon with at least one light-sensitive silver halide emulsion layer.

For the purpose of maintaining a high sensitivity and improving an image sharpness with an X-ray sensitive material, there have been many proposals for causing a dye to fix.

For fixing a dye, there is a method of making combination use of a basic polymer and an acidic dye.

In the above-mentioned method, there is such a problem that a fixed dye remains undecolorized even by making a developing, fixing or washing treatment. When increasing a basicity of a basic macromolecule for increasing a fixing function, the bondage of the basic polymer to an acidic dye can be strengthened so that the dye can hardly be decolorized. When weakening the fixing function, on the contrary, the dye is readily be decolorized and, however, the dye is diffusively transferred to the adjacent emulsion layer, so that the photographic characteristics may be affected.

Therefore, an attempt has been tried to modify a chemical structure of a dye so as to be decomposable in the course of carrying out a developing or fixing treatment. However, when making use of a decomposable dye, the decomposition thereof is progressed in the course of preserving the subject film and, particularly in the course of preserving it at a high humidity, so that the attempt may have such a disadvantage that no stable characteristics can be achieved. In a technique in which the degrees of the above-mentioned fixing strength and the decomposability are optimized, the image-sharpness cannot be improved satisfactory. Particularly in recent years, a rapid processing technique has been so progressed that a 90-second processing, a 45-second processing and, further, a 30-second processing have been getting popularized, so that a satisfactory decolorization and an image-sharpness improvement have become more difficult.

Therefore, U.S. Pat. No. 4,803,150 proposes a method in which a dye is hardly soluble in an emulsion and is then contained in the form of solid particles so that the dye is made soluble in a developing treatment.

A rapid processing has rapidly been popularized and, on the other hand, the reduction of a binder amount and a highly-hardening have been tried for reducing the load on a drying treatment. The result thereof was that, in a method in which a conventional dye is added in the solid particle dispersion form, when adding a dye in an amount necessary to achieve a high image-sharpness, a residual dye coloring is produced; and, when adding a dye in an amount of not producing any residual dye coloring, the resulting image-sharpness is not satisfied.

SUMMARY OF THE INVENTION

It is an object of the invention to provide a silver halide photographic light-sensitive material improved in the above-mentioned disadvantages and provided with a high sensitivity, a high image-sharpness and a super-rapid processability, and the processing method thereof.

Another object of the invention is to provide a silver halide photographic light-sensitive material not producing any residual dye coloring and having a high sensitivity and a high image-sharpness, even when super-rapidly processed.

The above-mentioned objects of the invention can be achieved with a silver halide photographic light-sensitive material comprising a support bearing thereon at least one silver halide emulsion layer, wherein a dye represented by the following Formula (1) is contained in the form of a dispersion of solid particles dispersed in a hydrophilic colloidal layer solid form, and said silver halide emulsion layer contains polyhydric alcohol.

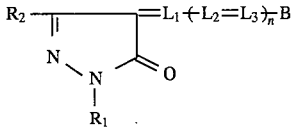

Formula (1)

wherein $R_1$ represents a hydrogen atom, an alkyl group, an aryl group or a heterocyclic group; $R_2$ represents a hydrogen atom, an alkyl group, an aryl group, a heterocyclic group, an alkoxycarbonyl group, an aryloxycarbonyl group, a carbamoyl group, an acylamino group, a ureido group, an amino group, an acyl group, an alkoxy group, an aryloxy group, a hydroxy group, a carboxy group, a cyano group, a sulfamoyl group or a sulfonamido group; B represents a 5- or 6-membered oxygen-containing heterocyclic group or a 6-membered nitrogen-containing heterocyclic group; $L_1$ through $L_3$ represent each a methine group; and n is an integer of 0 or 1, provided that the compounds represented by Formula (1) has at least one of a carboxy group, a sulfonamido group and a sulfamoyl group.

DETAILED DESCRIPTION OF THE INVENTION

Among the above-mentioned silver halide photographic light-sensitive materials, when making use of a silver halide photographic light-sensitive material containing gelatin in an amount of not more than 3.7 g/m$^2$ per one side of the light-sensitive material, preferably 1.0–3.7 g/m$^2$ and the foregoing polyhydric alcohol having a melting point within the range of 50° to 300° C., a more remarkable effect can be performed.

The above-mentioned objects of the invention can also be achieved with processing a silver halide photographic light-sensitive material in which the silver halide photographic light-sensitive material is developed for a period of time within 15 seconds.

A hydrophilic colloidal layer of the invention may contain silver halide grains.

First, the compounds represented by Formula (1) will be detailed. The alkyl groups represented by $R_1$ and $R_2$ include, for example, a methyl group, an ethyl group, an n-propyl group, an iso-propyl group, a t-butyl group, an n-pentyl group, an n-hexyl group, an n-octyl group, a 2-ethylhexyl group, an n-dodecyl group, an n-pentadecyl group and an eicosyl group. The alkyl groups also include, for example, a substituent. The substituents include, for example, a halogen atom (such as an atom of chlorine, bromine, iodine or fluorine), an aryl group (such as a phenyl group and a naphthyl group), a cycloalkyl group (such as a cyclopentyl group and a cyclohexyl group), a heterocyclic group (such as a pyrrolidyl group, a pyridyl group, a furyl group and a thienyl group), a sulfinic acid group, a carboxy group, a nitro group, a hydroxyl group, a mercapto group, an amino group (such as am amino group and a diethylamino group), an alkyloxy group (such as a methyloxy group, an ethyloxy group, an n-butyloxy group, an n-octyloxy group and an isopropyloxy group), an aryloxy group (such as a phenyloxy group and a naphthyloxy group), a carbamoyl group (such as an amino-carbonyl group, a methylcarbamoyl group, an n-pentylcarbamoyl group and a phenylcarbamoyl group), an amido group (such as a methylamido group, a benzamido group and an n-octylamido group), an aminosulfonylamino group (such as an amino-sulfonylamino group, a methylaminosulfonylamino group and an anilinosulfonylamino group), a sulfamoyl group (such as a sulfamoyl group, a methylsulfamoyl group, a phenylsulfamoyl group and an n-butylsulfamoyl group), a sulfonamido group (such as a methanesulfonamido group, an n-heptanesulfonamido group and a benzenesulfonamido group), a sufinyl group (such as an alkylsulfinyl group, e.g., a methylsulfinyl group, an ethylsulfinyl group and an octylsulfinyl group, and an arylsulfinyl group, e.g., a phenylsulfinyl group), an alkyloxycarbonyl group (such as a methyloxycarbonyl group, an ethyloxycarbonyl group, a 2-hydroxyethyloxycarbonyl group and an n-octyloxycarbonyl group), an aryloxycarbonyl group (such as a phenyloxycarbonyl group and a naphthyloxycarbonyl group), an alkylthio group (such as a methylthio group, an ethylthio group and an n-hexylthio group), an arylthio group (such as a phenylthio group and a naphthylthio group), an alkylcarbonyl group (such as an acetyl group, an ethylcarbonyl group, an n-butylcarbonyl group and an n-octylcarbonyl group), an arylcarbonyl group (such as a benzoyl group, a p-methanesulfonamidobenzoyl group, a p-carboxybenzoyl group and a naphthoyl group), a cyano group, a ureido group (such as a methylureido group and a phenylureido group) and a thioureido group (such as a methylthioureido group and a phenylthioureido group).

The aryl groups each represented by $R_1$ and $R_2$ include, for example, a phenyl group and a naphthyl group. The aryl groups include, for example those having a substituent. The substituents include, for example, the foregoing groups given as the substituents for the foregoing alkyl groups or aryl groups.

The heterocyclic groups each represented by $R_1$ and $R_2$ include, for example, a pyridyl group (such as a 2-pyridyl group, a 3-pyridyl group, a 4-pyridyl group, a 5-carboxy-2-pyridyl group, a 3,5-dichloro-2-pyridyl group, a 4,6-dimethyl-2-pyridyl group, a 6-hydroxy-2-pyridyl group, a 2,3,5,6-tetrafluoro-4-pyridyl group and a 3-nitro-2-pyridyl group), an oxazolyl group (such as a 5-carboxyl-2-benzoxazolyl group, a 2-benzoxazolyl group and a 2-oxazolyl group), a thiazolyl group (such as a 5-sulfamoyl-2-benzothiazolyl group, a 2-benzothiazolyl group and a 2-thiazolyl group), an imidazolyl group (such as a 1-methyl-2-imidazolyl group and a 1-methyl-5-carboxy-2-benzimidazolyl group), a furyl group (such as a 3furyl group), a pyrrolyl group (such as a 3-pyrrolyl group), a thenyl group (such as a 2-thienyl group), a pyrazinyl group (such as a 2-pyrazinyl group), a pyrimidinyl group (such as a 2-pyrimidinyl group and a 4-chloro-2-pyrimidinyl group), a pyridazinyl group (such as a 2-pyridazinyl group), a purinyl group (such as an 8-purinyl group), an isoxazolyl group (such as a 3-isoxazolyl group), a selenazolyl group (such as a 5-carboxy-2-selenazolyl group), a sulfolanyl group (such as a 3-sulfolanyl group), and a tetrazolyl group (such as a 1-methyl-5-tetrazolyl group). These heterocyclic groups include those having a substituent. The substituents may include those exemplified as the foregoing alkyl groups and the substituents for the alkyl groups.

The alkoxycarbonyl groups represented by $R_2$ include, for example, a methoxycarbonyl group, an ethoxycarbonyl group, an i-propoxycarbonyl group, a t-butoxycarbonyl group, a pentyloxycarbonyl group and a dodecyloxycarbonyl group.

The aryloxycarbonyl groups represented by $R_2$ include, for example, an phenyloxycarbonyl group and a naphthyloxy-carbonyl group.

The carbamoyl groups represented by $R_2$ include, for example, an aminocarbonyl group, a methylcarbamoyl group, an ethylcarbamoyl group, an i-propylcarbamoyl group, a t-butylcarbamoyl group, a dodecylcarbamoyl group, a phenylcarbamoyl group, a 2-pyridylcarbamoyl group, a 4-pyridylcarbamoyl group, a benzylcarbamoyl group, a morpholinocarbamoyl group and a piperazinocarbamoyl group. The acylamino groups represented by $R_2$ include, for example, a methylcarbonylamino group, an ethylcarbonylamino group, an i-propylcarbonylamino group, a t-butylcarbonylamino group, a dodecylcarbonylamino group, a phenylcarbonylamino group and a naphthylcarbonylamino group.

The ureido groups represented by $R_2$ include, for example, a methylureido group, an ethylureido group, an i-propylureido group, a t-butylureido group, a dodecylureido group, a phenylureido group, a 2-pyridylureido group and a thiazolylureido group.

The amino groups represented by $R_2$ include, for example, an amino group, a methylamino group, an ethylamino group, an i-propylamino group, a t-butylamino group, an octylamino group, a dodecylamino group, a dimethylamino group, an anilino group, a naphthylamino group, a morpholino group and a piperazino group.

The acyl groups represented by $R_2$ include, for example, a methylcarbonyl group, an ethylcarbonyl group, an i-propylcarbonyl group, a t-butylcarbonyl group, an octylcarbonyl group, a dodecylcarbonyl group, a phenylcarbonyl group and a naphthylcarbonyl group.

The alkoxy groups represented by $R_2$ include, for example, a methoxy group, an ethoxy group, an i-propoxy group, a t-butyloxy group and a dodecyloxy group.

The aryloxy groups represented by $R_2$ include, for example, a phenoxy group and a naphthyloxy group.

The sulfamoyl groups represented by $R_2$ include, for example, an aminosulfonyl group, a methylsulfamoyl group, an i-propylsulfamoyl group, a t-butylsulfamoyl group, a dodecylsulfamoyl group, a phenylsulfamoyl group, a 2-pyridylsulfamoyl group, a 4-pyridylsulfamoyl group, a morpholinosulfamoyl group and a piperazinosulfamoyl group.

The sulfonamido groups represented by $R_2$ include, for example, a methylsulfonamido group, an ethylsulfonamido group, an i-propylsulfonamido group, a t-butylsulfonamido group, a dodecylsulfonamido group, a phenylsulfonamido group and a naphthylsulfonamido group.

Each of these groups includes those having a substituent. The substituents include, for example, those exemplified as the substituents for the foregoing alkyl groups denoted by $R_1$ and $R_2$ and for the substituents for the foregoing alkyl groups denoted by $R_1$ and $R_2$.

In Formula (1), the 5- or 6-membered oxygen-containing heterocyclic groups and the 6-membered nitrogen-containing heterocyclic groups, each denoted by B include, for example, a furyl group (such as a 2-furyl group, a 3-furyl group, a 2-benzofuranyl group, a 3-benzofuranyl group and a 1-isobenzofuranyl group), a pyranyl group (such as a 2-tetrahydropyranyl group, a 3-2H-pyranyl group, a 4-2H-pyranyl group, a 5-2H-pyranyl group, a 6-2H-pyranyl group, a 2-4H-pyranyl group, a 3-4H-pyranyl group, a 2-chromanyl group, a 3-chromanyl group, a 4-2H-chromenyl group and a 2-4H-chromenyl group), a pyronyl group (such as a 2-4H-pyronyl group, a 3-4H-pyronyl group, a 2-chromonyl group, a 3-coumarinyl group and a 3-chromonyl group), a pyridyl group (such as a 2-pyridyl group, a 3-pyridyl group, a 4-pyridyl group, a 2-quinolyl group, a 3-quinolyl group, a 4-quinolyl group, a 9-acridinyl group and a 3-thienopyridyl group), a pyrazinyl group (such as a 2-pyrazinyl group), a pyrimidinyl group (such as a 2-pyrimidinyl group, a 4-pyrimidinyl group, a 5-pyrimidinyl group and a 2-quinazolinyl group) and a piperidinyl group (such as a 3-piperidinyl group). The heterocyclic groups include those having a substituent. The substituents include, for example, those exemplified as the foregoing alkyl groups denoted by $R_1$ and $R_2$ and the substituents for the foregoing alkyl groups, and further include those exemplified as the amino groups, alkoxy group and aryloxy groups each denoted by $R_2$.

In Formula (1), the methine groups denoted by $L_1$ through $L_3$ also include, for example, those having a substituent. The substituents include, for example, an alkyl group (such as a methyl group, an ethyl group, an isopropyl group, a t-butyl group, a 3-hydroxypropyl group and a benzyl group), an aryl group (such as a phenyl group), a halogen atom (such as a chlorine atom, a bromine atom, an iodine atom and a fluorine atom), an alkoxy group (such as a methoxy group and an ethoxy group), an acyloxy group (such as a methyl-carbonyloxy group and a phenylcarbonyloxy group).

Now, the exemplary examples of the compounds of the invention will be given below. However, the invention shall not be limited thereto.

TABLE 1

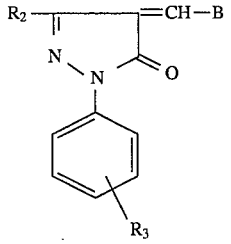

| Compound No. | $R_2$ | $R_3$ | B |
|---|---|---|---|
| 1-1 | $-CH_3$ | 4-COOH | 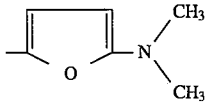 |
| 1-2 | $-COOC_2H_5$ | 4-COOH | 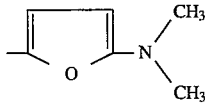 |
| 1-3 | $-CONH_2$ | 4-COOH | 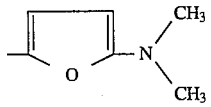 |
| 1-4 | $-COCH3$ | 4-COOH | 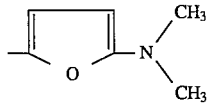 |
| 1-5 | $-CN$ | 4-COOH | 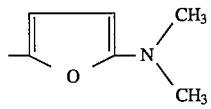 |
| 1-6 | $-CONH_2$ | $4\text{-}SO_2NH_2$ | 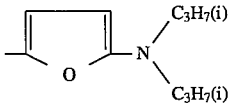 |
| 1-7 | 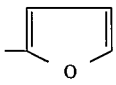 | 2-COOH, 5-COOH | 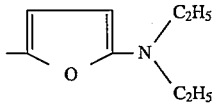 |

TABLE 1-continued
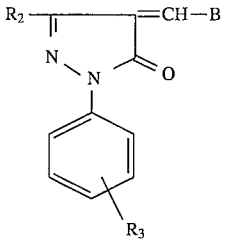
| Compound No. | $R_2$ | $R_3$ | B |
|---|---|---|---|
| 1-8 | $-OC_2H_5$ | 3-COOH | 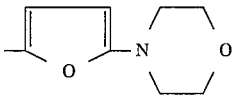 |
| 1-9 | $-COCH_3$ | 2-COOH | 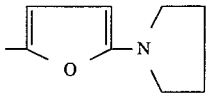 |
| 1-10 | $-COOC_2H_5$ | 4-$NHSO_2CH_3$ | 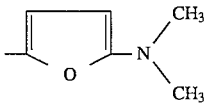 |
TABLE 2
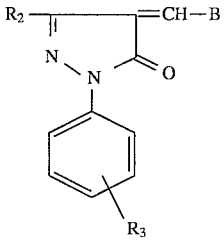
| Compound No. | $R_2$ | $R_3$ | B |
|---|---|---|---|
| 1-11 | $-COOH$ | 4-$NHSO_2CH_3$ | 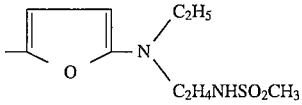 |
| 1-12 | $-CONH_2$ | 2-COOH, 5-COOH | 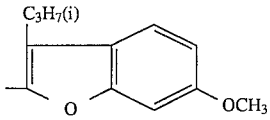 |
| 1-13 | $-COCH_3$ | 3-COOH | 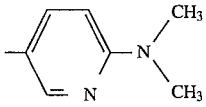 |
| 1-14 | $-COCH_3$ | 4-COOH | 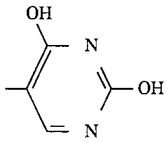 |

TABLE 2-continued
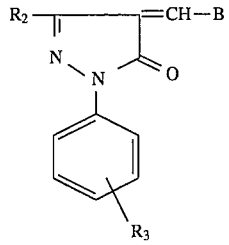
| Compound No. | $R_2$ | $R_3$ | B |
|---|---|---|---|
| 1-15 | $-COC_2H_5$ | 4-COOH | 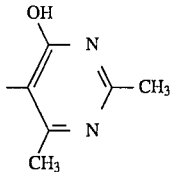 |
| 1-16 | $-COOCH_3$ | 4-COOH | 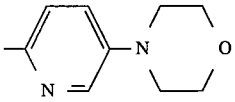 |
| 1-17 | $-COCH_3$ | 2-COOH, 5-COOH | 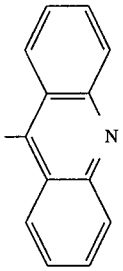 |
| 1-18 | $-COOH$ | H | 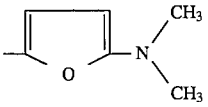 |
TABLE 3
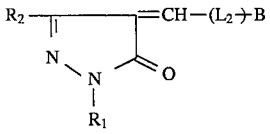
| Compound No. | $R_2$ | $R_1$ | $L_2$ | B |
|---|---|---|---|---|
| 1-19 | $-COOC_2H_5$ | 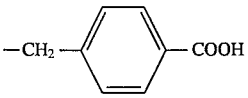 | — | 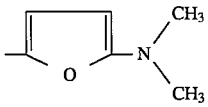 |
| 1-20 | 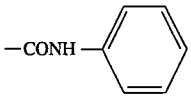 | $-CH_2COOH$ | — | 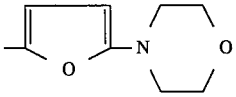 |
| 1-21 | $-COOH$ | $-CH_3$ | — | 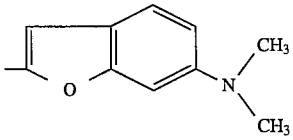 |

TABLE 3-continued

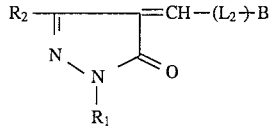

| Compound No. | $R_2$ | $R_1$ | $L_2$ | B |
|---|---|---|---|---|
| 1-22 | $-NHCONHCH_3$ | $-CH_2COOH$ | $-CH=CH-$ | 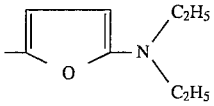 |
| 1-23 | $-CN$ | 4-COOH | — | 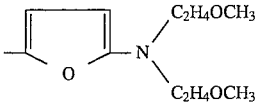 |
| 1-24 | $-CN$ | 4-COOH | — | 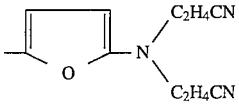 |

TABLE 4

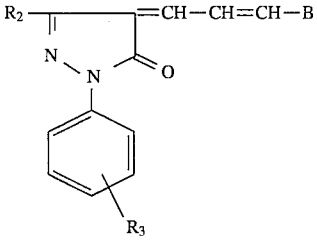

| Compound No. | $R_2$ | $R_3$ | B |
|---|---|---|---|
| 1-25 | $-COOC_2H_5$ | 4-COOH | 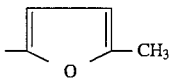 |
| 1-26 | $-CH_3$ | 3-COOH, 5-COOH | 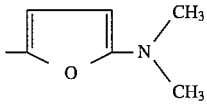 |
| 1-27 | $-COOC_2H_5$ | 4-COOH | 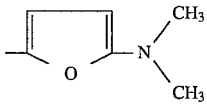 |
| 1-28 | $-COOC_2H_5$ | 4-COOH | 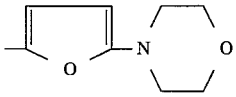 |

Now, the exemplary synthesization examples of the compounds of the invention will be given below. However, the other compounds may readily be synthesized in the similar manner.

Synthesization example 1

Synthesis of exemplified compound (1-2):

A mixture of 27.6 g of 1-(4-carboxyphenyl)-3-ethoxycarbonyl-2-pyrazoline-5-one, 14.0 g of 5-dimethylaminofurfural, 10.2 g of triethylamine and 500 ml of ethanol was heatedly stirred for 3 hours under the reflux condition. After the resulting reaction mixture was allowed to cool, 10.0 g of acetic acid was added thereto and the resulting product was filtrated therefrom. The product was formed into a slurry under reflux in ethanol and the slurry was then refined by a filtration. Upon repetition of the above-mentioned procedures, 19.0 g of Compound (2) was obtained. The structure of the resulting compound was confirmed through NMR, IR and MASS spectrography.

To the silver halide emulsion layer of a silver halide photographic light-sensitive material of the invention, polyhydric alcohol is added in an amount within the range of $1.0\times10^{-3}$ mols to $5.0\times10^{-1}$ mols per mol of silver halide used therein.

An amount of polyhydric alcohol added thereto is preferably within the range of $5.0\times10^{-2}$ mols to $2.0\times10^{-1}$ mols per mol of the silver halide used.

Polyhydric alcohol preferably applicable to the invention include, for example, those having 2 to 12 hydroxyl groups and 2 to 20 carbon atoms in a molecule, which are preferably aliphatic polyalcohols. Besides the above, those having a melting point within the range of not lower than 50° C. to not higher than 300° C. are further preferable.

Now, the exemplary examples of polyhydric alcohol preferably applicable to the embodiments of the invention will be given below. However, polyhydric alcohol applicable to the invention shall not be limited to the above-given concrete examples thereof.

| No. | Compound | Melting point (°C.) |
|---|---|---|
| 2-1 | 2,3,3,4-tetramethyl-2,4-pentadiol | 76 |
| 2-2 | 2,2-dimethyl-1,3-propanediol | 126–128 |
| 2-3 | 2,2-dimethyl-1,3-pentadiol | 60–63 |
| 2-4 | 2,2,4-trimethyl-1,3-pentadiol | 52 |
| 2-5 | 2,5-hexanediol | 43–44 |
| 2-6 | 2,5-dimethyl-2,5-hexanediol | 92–93 |
| 2-7 | 1,6-hexanediol | 42 |
| 2-8 | 1,8-octanediol | 60 |
| 2-9 | 1,9-nonanediol | 45 |
| 2-10 | 1,10-decanediol | 72–74 |
| 2-11 | 1,11-undecanediol | 62–62.5 |
| 2-12 | 1,12-dodecanediol | 79–79.5 |
| 2-13 | 1,13-tridecanediol | 76.4–76.5 |
| 2-14 | 1,14-tetradecanediol | 83–85 |
| 2-15 | 1,12-octadecanediol | 66–67 |
| 2-16 | 1,18-octadecanediol | 96–98 |
| 2-17 | Cis-2,5-dimethyl-3-hexene-2,5-diol | 69 |
| 2-18 | Trans-2,5-dimethyl-3-hexene-2,5-diol | 77 |
| 2-19 | 2-butyne-1,4-diol | 55 |
| 2-20 | 2,5-dimethyl-3-hexyne-2,5-diol | 95 |
| 2-21 | 2,4-hexadiyne-1,6-diol | 111–112 |
| 2-22 | 2,6-octadiyne-1,8-diol | 88.5–89.5 |
| 2-23 | 2-methyl-2,3,4-butanetriol | 49 |
| 2-24 | 2,3,4-hexanetriol | approx. 47 |
| 2-25 | 2,4-dimethyl-2,3,4-pentanediol | 89 |
| 2-26 | 2,4-dimethyl-2,3,4-hexanediol | 75 |
| 2-27 | Pentanemethyl glycerol | 116–117 |
| 2-28 | 2-methyl-2-oxymethyl-1,3-propanediol | 199 |
| 2-29 | 2-isopropyl-2-oxymethyl-1,3-propanediol | 83 |
| 2-30 | 2,2-dihydroxymethyl-1-butanol | 58 |
| 2-31 | Erythritol | 126 |

A silver halide emulsion applicable to a silver halide photographic light-sensitive material of the invention may comprise silver bromide grains, silver iodobromide grains or silver iodochlorobromide grains containing a small amount of silver chloride. A silver halide grain may have any crystal forms, provided that is can satisfy the constitution of the invention. For example, it may be either a single crystal such as a cube, an octahedron and a tetradecahedron, or a multiple twinned-crystal grain having various forms.

An emulsion applicable to a silver halide photographic light-sensitive material of the invention may be prepared in any well-known processes. For example, it can be prepared in the process described in "Emulsion Preparation and Types" appeared in Research Disclosure (RD) No. 17643 (Dec., 1978), pp. 22–23; or the process described in ibid., No. 18716 (Nov., 1979), p. 648.

An emulsion applicable to a silver halide photographic light-sensitive material of the invention can be prepared in the manner described in, for example, T. H. James, "The Theory of the Photographic Process", the 4th Ed., Macmillan Co., (1977), pp. 38–104; G. F. Duffin, "Photographic Emulsion Chemistry", Focal Press Co., (1966); P. Glafkides, "Chemie et Physique Photographique", Paul Montel Co., (1967); or V. L. Zelikman et al, "Making And Coating Photographic Emulsion", Focal Press Co., (1964).

In other words, the above-mentioned emulsion can be prepared under the following conditions; the solution conditions as in an acidic, ammoniacal or neutral emulsion, the precipitation conditions such as a reverse, double-jet or controlled double-jet precipitation, the grain-preparation condition such as a conversion or core/shell grain-preparation condition, and the combination of the above-mentioned conditions.

An emulsion applicable to a silver halide photographic light-sensitive material of the invention include, for example, a monodisperse type emulsion containing silver iodide in the grains thereof as a preferable embodiment of the emulsions. The term, "monodisperse type", herein means such a type that, when an average grain-size of a silver halide grains is obtained in an ordinary method, at least 95% by number or weight of the whole grains of a silver halide emulsion are to have each a grain-size within the range of ±40% and, preferably, within ±30% of the average grain-size.

An emulsion applicable to a silver halide photographic light-sensitive material of the invention may be a monodisperse type emulsion having a relatively narrow silver halide grain-size distribution or may also be a polydisperse type emulsion having a relatively wide silver halide grain-size distribution. A silver halide crystal structure may be composed of silver halide compositions different between the inside and the outside. For example, such an emulsion as mentioned above may also include a core/shell type monodisperse emulsion having such a two-layered structure that the high silver iodide-containing core portion thereof is covered with a low silver iodide-containing shell layer.

The processes of preparing the above-mentioned monodisperse type emulsions have been well known. For example, the processes thereof are detailed in Journal of Photographic Science, No. 12,242–251, (1963), JP OPI Publication Nos. 48-36890/1973, 52-16363/1977, 55-142329/1980 and 58-49938/1983, British Patent No. 1,413,748, and U.S. Pat. Nos. 3,574,628 and 3,655,394.

An emulsion applicable to a silver halide photographic light-sensitive material of the invention also include, for example, an emulsion prepared in such a process for obtaining the above-mentioned monodisperse type emulsion, in which silver ions and halide ions are so supplied as to grow up seed crystals used as the growth nuclei of the emulsion grains.

The processes of preparing the above-mentioned core/shell type emulsions have been well known. For example, the processes thereof can be referred to Journal of Photographic Science, No. 24.198, (1976), U.S. Pat. Nos. 2,592,250, 3,505,068, 4,210,450 and 4,444,877, or JP OPI Publication No. 60-143331/1985.

emulsion applicable to a silver halide photographic light-sensitive material of the invention may also be those comprising tabular-shaped grains having an aspect ratio (a ratio of a grain-size/a grain thickness) of not lower than 3. The advantages of such a tabular-shaped grain as mentioned above are that a spectral sensitization can be increased and the graininess and sharpness of an image can also be improved, as disclosed in, for example, British Patent No. 2,112,157 and U.S. Pat. Nos. 4,414,310 and 4,434,226. The emulsion can be prepared in the processes described in the above-given patent publication.

The above-mentioned emulsion may also be any one of the emulsions of the following types, namely, a surface latent image-forming emulsion type in which a latent image is formed mainly on the surfaces of the grains, a internal latent image-forming emulsion in which a latent image is formed mainly inside the grains, and an emulsion of such as type that a latent image can be formed both on the surfaces of the grains and in the inside of the grains.

In the preparation of these emulsions, a cadmium salt, a lead salt, a zinc salt, a thallium salt, an iridium salt or the complex salts thereof, a rhodium salt or the complex salts thereof, or an iron salt, the complex salts thereof, or the like may also be used in the physical ripening or grain growth stage.

For removing a soluble salt from an emulsion, a noodle-washing method, a flocculation-coagulation method may be used. The preferable washing methods include, for example, a method in which an sulfo group-containing aromatic hydrocarbon/aldehyde condensation resin is used as described in JP OPI Publication No. 35-16086/1960, or a desalting method in which exemplified compounds G-3, G-8 and so forth, which are polymeric flocculants given in JP OPI Publication No. 63-158644/1988.

In an emulsion applicable to a silver halide photographic light-sensitive material of the invention, various kinds of photographic additives may be used in the steps before or after carrying out a physical or chemical ripening treatment. The compounds applicable to such a step as mentioned above include, for example, such a variety of compounds as given in the foregoing RD Nos. 17643, 18716 and 308119, (December, 1989). The compounds given therein are as listed below.

| | RD-17643 | | RD-18716 | RD-308119 | |
|---|---|---|---|---|---|
| Additive | Page | Group | Page | Page | Group |
| Chemical sensitizer | 23 | III | Upper-right of 648 | 996 | III |
| Sensitizing dye | 23 | IV | 648–649 | 996–8 | IV |
| Desensitizing dye | 23 | IV | | 998 | B |
| dyestuff | 25–26 | VIII | 649–650 | 1003 | VIII |
| Development accelerator | 29 | XXI | Upper-right of 648 | | |
| Antifoggant & stabilizer | 24 | IV | Upper-right of 649 | 1006–7 | VI |
| Whitening agent | 24 | V | | 998 | V |
| Layer hardener | 26 | X | Left of 651 | 1004–5 | X |
| Surfactant | 26–27 | XI | Right of 650 | 1005–6 | XI |
| Plasticizer | 27 | XII | Right of 650 | 1006 | XII |
| Lubricant | 27 | XII | | | |
| Matting agent | 28 | XVI | Right of 650 | 1008–9 | XVI |
| Binder | 26 | XXII | | 1003–4 | IX |
| Support | 28 | XVII | | 1009 | XVII |

The supports applicable to a silver halide photographic light-sensitive material of the invention include, for example, those described in the foregoing RDs. The suitable supports include, for example, a plastic film that may also be provided thereto with a subbing layer or applying a corona-discharge or a UV irradiation thereto so as to improve the adhesiveness of a layer coated thereon.

A light-sensitive material of the invention may be photographically treated with a processing solution, as described in the foregoing RD-17643, XX—XXI, pp. 29–30 or (RD)-308119, XX—XXI, pp. 1011–1012. The above-mentioned treatments may also be a black-and-white photographic treatment for forming a silver image.

Such a processing treatment as mentioned above may be carried out usually at a temperature within the range of 18° C. to 50° C.

As for a developing agent applicable to a black-and-white photographic treatment, a dihydroxybenzene (such as hydroquinone), a 3-pyrazolidone (such as 1-phenyl-3-pyrazolidone) and an aminophenol (such as N-methyl-P-aminophenol), for example, may be used singly or in combination thereof. To a developer, it is also allowed, if required, to add the following well-known additives, namely, a preservative, an alkali, a pH buffer, an antifoggant, a hardener, a development accelerator, a surfactant, a defoamer, a color toner, a water softener, a dissolution aid and a thickener.

In a fixing solution, a fixing agent such as a thiosulfate or a thiocyanate is used, and a water-soluble aluminum salt such as aluminum sulfate and potassium alum may be contained as a layer hardener. Besides the above, a preservative, a pH buffer, a water softener and so forth may further be contained therein.

EXAMPLES

Now, the invention will be detailed with the citation of the following examples. However, the invention shall not be limited to the examples given hereinafter.

Example 1

Preparation of fine particle dye dispersion

Five grams of the dried powder of each test dye was added to 500 ml of water and the mixtures was then dispersed at 25° C. and 15000 rpm for 8 hours. An average particle-size and the particle-size distribution were measuredby a laser-diffracting/scattering type particle-size distribution measurement instrument Model LA-700 manufactured by Horiba Mfg. Works, Ltd. The resulting particles were proved to have an average particle-size of 0.2μ and a particle dispersion degree within 20% in terms of a variation coefficient of particle-size distribution.

Preparation of a crossover-cut layer

On the both sides of a blue-tinted, 175μ-thick polyethylene terephthalate support, a crossover-cut layer of the following composition was coated in an amount coated per one side of the support, so that the sample of the support was prepared.

| | |
|---|---|
| Dye | Amount as shown in Table 5 |
| Gelatin | Amount as shown in Table 5 |
| Nonylphenoxypolyethylene oxide (having a polymerization degree of 10) | 0.006 g/m$^2$ |
| Anhydro-1-(morpholino-N-carbonyl)-4-(2-sulfoethyl)-pyridium.hydroxide | 0.08 g/m$^2$ |
| Methyl polymethacrylate (a matting agent having an average particle-size of 2.5μ) | 0.002 g/m$^2$ |

<Preparation of seed emulsion>

A hexagonal, tabular-shaped seed grain emulsion was prepared in the following manner.

Solution A

| | |
|---|---|
| Ossein gelatin | 60.2 g |
| Distilled water | 20 l |
| Sodium polyisopropylene-polyethyleneoxy-disuccinate (in an aqueous 10% ethanol solution) | 5.6 ml |
| KBr | 26.8 g |
| 10% $H_2SO_4$ | 144 ml |

-continued

| | |
|---|---|
| Solution B | |
| An aqueous 2.5N $AgNO_3$ solution | 3500 ml |
| Solution C | |
| KBr | 1029 g |
| KI | 29.3 g |
| Add distilled water to make | 3500 ml |
| Solution D | |
| An aqueous 1.75N KBr solution | An amount for controlling the following silver potential |

By making use of a mixing stirrer described in JP Examined Publication Nos. 58-58288/1983 and 58-58289/1983, 64.1 ml each of Solutions B and C were added to Solution A at 35° C. by a double-jet addition method by taking two minutes to form nucleus grains.

After stopping the addition of Solutions B and C, the temperature of Solution A was raised up to 60° C. by taking 60 minutes and, thereto Solutions B and C were further added by a double-jet addition method at a flow rate of 68.5 ml/min. for 50 minutes, respectively. The silver potential in the above-mentioned course, (that was measured by a silver-ion selective electrode using a saturated silver-silver chloride electrode as a reference electrode), was so controlled as to be +6 mv, by making use of Solution D.

After completing the addition of the solutions, the pH thereof was adjusted to be 6 and then, immediately, a desalting and washing treatments were each carried out. The resulting emulsion is herein denoted by Seed emulsion Em0. Em0 was comprised of hexagonal, tabular-shaped grains having a maximum adjacent side ratio within the range of 1.0 to 2.0, which occupied not less than 90% of the whole projected area of the silver halide grains. By the electron microscopic observation, the hexagonal, tabular-shaped grains were shown to have an average grain-thickness of 0.07 μm and an average grain-size of 0.5 μm in terms of the diameter of a circle converted from the subject grain (circle equivalent diameter).

Preparation of a thick tabular grain emulsion

By making use of the following four kinds of solutions, a thick tabular-shaped silver iodobromide emulsion Em1 was prepared.

| | |
|---|---|
| Solution E | |
| Ossein gelatin | 29.4 g |
| Seed emulsion EM0 | An amount equivalent to 1.6 mols |
| Sodium polyisopropylene-polyethyleneoxy-disuccinate (aqueous 10% ethanol solution) | 2.5 ml |
| Add distilled water to make | 1400 ml |
| Solution F | |
| An aqueous 3.5N $AgNO_3$ solution | 2360 ml |
| Solution G | |
| KBr | 963 g |
| KI | 27.4 g |
| Add distilled water to make | 2360 ml |
| Solution H | |
| An aqueous 1.75N KBr solution | An amount for controlling the following silver potential |

Similarly to the foregoing case, by making use of a mixing stirrer described in JP Examined Publication Nos. 58-58288/1983 and 58-58289/1983, the whole amount of Solutions F and G was added to Solution E at 60° C. and at a flow rate of 21.26 l/min., by a double-jet precipitation method by taking two minutes, so that the grain growth could be carried out.

In the above-mentioned courses, the silver potential was controlled to be +25 mv by making use of Solution H. Next, for removing any excessive salts, a coagulation desalting treatment was carried out by making use of an aqueous solution of Demol (manufactured by Kao-Alas Corp.) and an aqueous magnesium sulfate solution. Then, an aqueous gelatin solution containing 92.2 g of ossein gelatin was added thereto and the resulting mixture was so stirred as to be dispersed.

The grains of the resulting emulsion Em1 were proved to be the thick tabular-shaped silver iodobromide grains having an average projected area diameter of 0.65 μm, a thickness of 0.26 μm, an aspect ratio of 2.5 and a silver iodide content of 1.1 mol %.

Preparation of monodisperse grain emulsion

The nuclei were comprised of excellently monodispersed grains having a variation coefficient that is the criterion of a monodispersivity, of 0.15, comprising silver iodobromide containing 2.0 mo % iodide, having an average grain-size of 0.2 μm having the cubic shape. Silver iodobromide containing 30 mol % of silver iodide was grown up thereon at pH 9.8 and pAg 7.8. Then, potassium bromide and silver nitrate were added in an equivalent mol thereto at pH8.2 and pAg 9.1 to prepare the emulsion comprising monodisperse emulsion grains having an average grain-size of 0.54 μm, a tetradeca- hedral shape and a variation coefficient of 0.17 so that the emulsion could be comprised of silver iodobromide grains having an average silver iodide content of 2.2 mol %. The resulting emulsion is herein denoted as Em2.

From the resulting emulsion, the excessive salts were desalted by an ordinary flocculation method. Thus, while keeping the temperature at 40° C., a formalin condensate of sodium naphthalenesulfonate and an aqueous magnesium sulfate solution were added to the emulsion to form coagulum, and the resulting supernatant was removed. To each of the resulting silver halide emulsions Em1 and Em2, water was added so as to make a volume of 300 ml per mol of silver, and the resulting emulsion was kept at 55° C.

Next, the later-mentioned spectrally sensitizing dyes A (10 g) and B (0.1 g) were mixed together and 490 g of water controlled to be 27° C. in advance was added thereto. After that, the resulting solution was stirred at 3,500 rpm for 30 to 120 minutes by making use of a high-speed stirrer (dissolver), so that a solid particle dispersion of the spectrally sensitizing dyes. The resulting dispersion was added to each of were formed Em1 and Em2 so that the total addition amount of the sensitizing dyes into Em1 and Em2 were 540 mg and 400 mg, each per mol of silver halide, respectively.

After 10 minutes, ammonium thiocyanate was added in an amount of $2\times10^{-3}$ mols to Em1 and in an amount of $4\times10^{-3}$ mols to Em2, each per mol of silver, and a suitable amounts of chloroauric acid and hypo were further added thereto. Then Em1 and Em2 were each commenced to be chemically ripened, respectively. At that time, the ripening treatments were carried out under the conditions of the pH of 6.15 and the silver potential of 50 mv.

To emulsion Em1 , silver iodide fine grains were added in an amount of 4.0 g per mol of silver at 70 minutes before completing the chemical ripening treatment and thereafter 4-hydroxy-6-methyl-1,3,3a,7-tetrazaindene was then added, so that the chemical ripening treatment was completed. To emulsion Em2, potassium iodide was added in an amount of 200 mg per mol of silver at 15 minutes before completing the chemical ripening treatment, and 10% (by wt/vol) of acetic acid was then added at 5 minutes thereafter so as to lower the pH down to 5.6 to be kept further for 5 minutes. Thereafter, the pH was recovered to be 6.15 by adding a 0.5% (by wt/vol) potassium hydroxide solution and then 4-hydroxy-6-methyl-1,3,3a,7-tetrazaindene was added, so that the chemical ripening treatment was completed.

To the resulting emulsions Em1 and Em2, the additives as described later were added so as to prepare a coating solution.

After preparing a photographic emulsion-coating solution, the pH and silver potential (pAg) thereof were adjusted to 6.20 and 80 mv (at 35° C.) by making use of sodium carbonate and potassium bromide, respectively.

Samples were each prepared by making use of the resulting emulsion-coating solution, as described below. In each of the samples, a photographic emulsion layer was coated in a silver coverage of 2.0 g/m$^2$ (in terms of a metal-silver content) per one side of each sample and in a gelatin amount per one side each of the samples, as shown in Table 5.

A protective layer coating solution was prepared by making use of the additives as described below. The resulting protective layer, together with the foregoing emulsion layer, was coated in a gelatin amount of 0.9 g/m$^2$ per one side of a support; the above-mentioned two layers were coated together at the same time on the support with the foregoing crossover-cut layer by making use of two units of slide-hopper type coating machines at a coating speed of 80 m/min., and were then dried up, so that a sample was prepared.

The following spectral sensitizing dyes were used for preparing the sample.

Spectral sensitizing dye A

Sodium 5,5'-dichloro-9-ethyl-3,3'-di-(3-sulfopropyl) oxacarbocyanine anhydride

Spectral sensitizing dye B

Sodium 5,5'-di-(butoxycarbonyl)-1,1'-diethyl-3,3'-di-(4-sulfobutyl)benzoimidazolocarbocyanine anhydride The following additives were used for the emulsion (that was a light-sensitive silver halide coating solution). The amounts thereof added to the emulsion are indicated by the amounts each per mol of the silver halide of the emulsion.

| | |
|---|---|
| 1,1-dimethylol-1-bromo-1-nitromethane | 10 mg |
| t-butyl-catechol | 70 mg |
| Polyvinyl pyrrolidone (having a molecular weight of 10,000) | 1.0 g |
| A styrene-anhydrous maleic acid copolymer | 2.0 g |
| Nitrophenyl-triphenyl phosphonium chloride | 5.0 mg |
| Ammonium 1,3-dihydroxybenzene-4-sulfonate | 2.0 g |
| Sodium 2-mercaptobenzimidazole-5-sulfonate | 1.5 mg |
| $C_4H_9OCH_2CH(OH)CH_2N(CH_2COOH)_2$ | 1.5 g |
| 1-phenyl-5-mercaptotetrazole | 15 mg |
| Polyhydric alcohol (See Table 5) | See Table 5 |
| 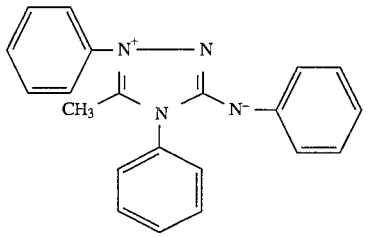 | 150 mg |
| 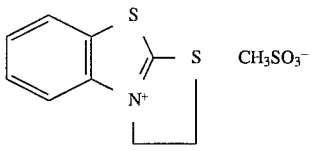 | 70 mg |
| 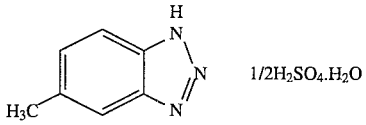 | 500 mg |
| 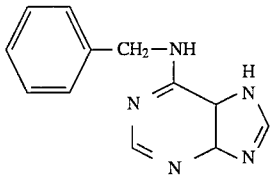 | 100 mg |

-continued

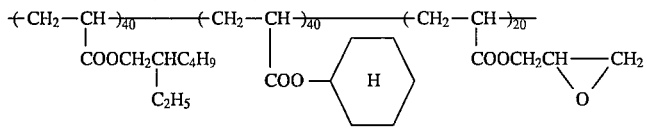

40 g

The following additives were used for the protective layer coating solution. The weights of the additives are indicated by a weight per liter of the coating solution.

| | |
|---|---|
| Lime-treated inert gelatin | 58 g |
| Acid-treated gelatin | 2 g |
| Sodium i-amyl-n-decylsulfosuccinate | 1.0 g |
| Polymethyl methacrylate, a matting agent having an area average particle-size of 3.5 μm | 0.4 g |
| Silicon dioxide, a matting agent having an area average particle-size of 1.21 μm | 0.7 g |
| Rudox AM (manufactured by DuPont), colloidal silica | 3.0 g |
| An aqueous 2% solution of sodium 2,4-dichloro-6-hydroxy-1,3,5-triazine, (a layer hardener) | 10 ml |
| An aqueous 40% glyoxal solution, (a layer hardener) | 5.0 ml |
| $(CH_2{=}CHSO_2CH_2)_2O$, (a layer hardener) | 500 mg |
| $C_{12}H_{25}CONH(CH_2CH_2O)_5H$ | 3.0 g |
| 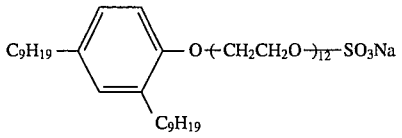 | 1.0 g |
| 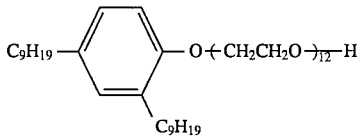 | 0.4 g |
| $NaO_3S{-}CH(CH_2COOCH_2(C_2F_4)_3H)COOCH_2(C_2F_4)_3H$ | 0.25 g |

Each of the resulting samples was exposed to light for 0.1 seconds at 3.2 CMS without using any filter, by making use of a light-source emitting standard light B, that is so-called a white exposure, described in "A Data Book of Illumination, A New Edition", the 2nd impression of the 1st edition, editted by A Corporation of Illumination Society, p. 39. When the samples were exposed to light, the both sides of the films were exposed to light so that the both sides of the films were exposed to light in the same exposure amount. The sensitivity was determined by obtaining the reciprocal of an exposure amount necessary to increase a photographic black density by 1.0. The exposed samples were developed in the following manner.

The development was carried out using an automatic processor, Model SRX-502 (manufactured by Konica Corp.) was used. The temperatures of the developer, fixer and washing water were kept at 35° C., 33° C. and 18° C., respectively. The washing water was supplied in an amount of 7.0 liters per minute. The drying temperature was kept at 45° C. The whole processing steps were completed for 45 seconds. The above-mentioned process is hereinafter referred to as "Process A".

In Table 5, the sensitivities are each indicated by a sensitivity relative to the sensitivity of Sample No. 1 that is regarded to be 100.

Processing step

| Step | Processing temperature (°C.) | Processing time (sec) | Replenishing amount |
|---|---|---|---|
| Inserting | — | 1.2 | |
| Developing + crossover | 35 | 14.6 | 270 ml/m² |
| Fixing + crossover | 33 | 8.2 | 430 ml/m² |
| Washing + crossover | 18 | 7.2 | 7.0 l/min. |
| Squeezing | 40 | 5.7 | |
| Drying | 45 | 8.1 | |
| TOTAL | — | 45.0 | |

| | |
|---|---|
| Formula of developer | |
| Part-A (for 15-liter finishing) | |
| Potassium hydroxide | 470 g |
| Potassium sulfite (in a 50% solution) | 3000 g |
| Sodium hydrogen carbonate | 150 g |
| Pentasodium diethylenetriamine pentaacetate | 45 g |
| 5-methylbenzotriazole | 2.0 g |
| 1-phenyl-5-mercaptotetrazole | 0.2 g |
| Hydroquinone | 390 g |
| Add water to make | 5000 ml |
| Part-B (for 15-liter finishing) | |
| Glacial acetic acid | 220 g |
| Triethylene glycol | 200 g |
| 1-phenyl-3-pyrazolidone | 27 g |
| 5-nitroindazole | 0.45 g |
| n-acetyl-DL-penicillamine | 0.15 g |
| Add water to make | 5000 ml |
| Formula of fixer | |
| Part-A (for 19-liter finishing) | |
| Ammonium thiosulfate (in 70 wt/vol %) | 4000 g |
| Sodium sulfite | 175 g |
| Sodium acetate.trihydrate | 400 g |
| Sodium citrate | 50 g |
| Gluconic acid | 38 g |
| Boric acid | 30 g |
| Glacial acetic acid | 140 g |
| Part-B (for 19-liter finishing) | |
| Aluminum sulfate, (in terms of an anhydrous salt) | 65 g |
| Sulfuric acid (in 50 wt%) | 105 g |

Next, the whole processing step were carried out in the same manner as in Process A, provided that an automatic processor, Model SRX-502 (manufactured by Konica Corp.) was modified; the temperatures of the developing, fixing and washing were changed to 37° C., 33° C. and 18° C., respectively; the washing water was supplied in an amount of 7.0 liters per minute; that the drying temperature was kept at 55° C.; and the whole processing steps were completed for 30-seconds. The above-mentioned process is hereinafter referred to as "Process B".

| Step | Processing temperature (°C.) | Processing time (sec) | Replenishing amount |
|---|---|---|---|
| | Processing step | | |
| Inserting | — | 0.8 | |
| Developing + crossover | 37 | 9.7 | 270 ml/m² |
| Fixing + crossover | 33 | 5.5 | 430 ml/m² |
| Washing + crossover | 18 | 4.8 | 7.0 l/min. |
| Squeezing | 45 | 3.8 | |
| Drying | 45 | 5.4 | |
| TOTAL | — | 30.0 | |

The resulting samples were evaluated with respect to color residual property and image-sharpness, in the following manner. The results thereof will be shown in Table 5.

Evaluation on residual dye-coloring

The film samples processed in the above-mentioned Processes A and B were visually evaluated with respect to residual dye-coloring levels.

The evaluation criteria will be shown below.

A: Scarcely found any residual coloring.

B: A few residual coloring were found, but may not be much concerned practically.

C: Residual coloring were found and much concerned practically.

D: Apparent residual coloring were produced.

Evaluation on sharpness

The samples were exposed to X-rays through a chest phantom by making use of a screen, SRO-250 (manufactured by Konica Corp.). The samples were developed by the same automatic processor and processing chemicals as used in the foregoing sensitometry. The image-sharpness of the resulting samples were evaluated visually on a viewing lantern.

The evaluation criteria will be shown below.

A: Excellent.

B: Good.

C: Acceptable.

D: Inferior.

TABLE 5

| Sample No | Emulsion | Crossover-cut layer: Dye | (mg/m²) | Gelatin (g/m²) | Emulsion layer: Alcohol | (g/m²) | Gelatin (g/m²) | Relative sensitivity | Sharpness | Residual coloring: Process A | Process B | Remarks |
|---|---|---|---|---|---|---|---|---|---|---|---|---|
| 1 | Em-1 | — | — | 0.7 | — | — | 1.6 | 100 | D | A | A | Comp. |
| 2 | Em-1 | a | 8 | 0.7 | — | — | 1.6 | 86 | C | A | A | Comp. |
| 3 | Em-1 | a | 60 | 0.7 | — | — | 1.6 | 65 | A | C | D | Comp. |
| 4 | Em-1 | b | 18 | 0.7 | — | — | 1.6 | 82 | D | A | B | Comp. |
| 5 | Em-1 | b | 40 | 0.7 | — | — | 1.6 | 68 | B | C | D | Comp. |
| 6 | Em-1 | 1-3 | 40 | 0.7 | — | — | 1.6 | 82 | A | B | C | Comp. |
| 7 | Em-1 | 1-3 | 40 | 0.7 | 2-3 | 0.1 | 1.6 | 87 | A | A | A-B | Inv. |
| 8 | Em-1 | 1-3 | 40 | 0.7 | 2-3 | 0.5 | 1.6 | 87 | A | A | A | Inv. |
| 9 | Em-1 | 1-5 | 10 | 0.7 | 2-23 | 0.35 | 1.6 | 94 | B | A | A | Inv. |
| 10 | Em-1 | 1-5 | 30 | 0.7 | 2-23 | 0.35 | 1.6 | 87 | A | A | A | Inv. |
| 11 | Em-1 | 1-8 | 40 | 0.7 | 2-30 | 0.35 | 1.4 | 89 | A | A | A | Inv. |
| 12 | Em-1 | 1-8 | 40 | 0.7 | 2-30 | 0.35 | 1.8 | 89 | A | A | A | Inv. |
| 13 | Em-1 | 1-8 | 40 | 0.7 | 2-30 | 0.35 | 2.4 | 89 | A | A-B | B | Inv. |
| 14 | Em-1 | 1-23 | 40 | 0.7 | 2-3 | 0.35 | 1.6 | 87 | A | A | A | Inv. |
| 15 | Em-1 | 1-23 | 40 | 1.1 | 2-3 | 0.35 | 1.6 | 87 | A | A | A-B | Inv. |
| 16 | Em-2 | 1-10 | 40 | 0.7 | 2-6 | 0.35 | 1.6 | 84 | A | A | A | Inv. |
| 17 | Em-2 | 1-13 | 40 | 0.7 | 2-9 | 0.35 | 1.6 | 84 | A | A | A | Inv. |
| 18 | Em-2 | 1-27 | 40 | 0.7 | 2-17 | 0.35 | 1.6 | 89 | A | A | A | Inv. |

Comparative dyes a)

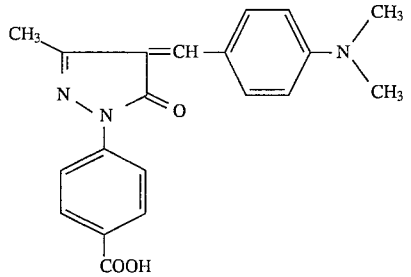

TABLE 5-continued

| Sample No | Emulsion | Crossover-cut layer Dye | (mg/m²) | Gelatin (g/m²) | Emulsion layer Alcohol | (g/m²) | Gelatin (g/m²) | Relative sensitivity | Sharpness | Residual coloring Process A | Process B | Remarks |
|---|---|---|---|---|---|---|---|---|---|---|---|---|
| b) 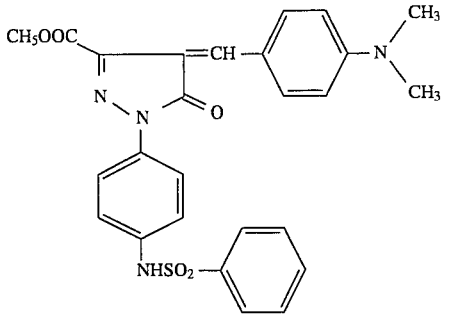 | | | | | | | | | | | | |

As is obvious from Table 5, the samples of the invention are proved that any color residual coloring is not produced even a super-rapid processing is carried out, and little in sensitivity deteriorations, and excellent in sharpness.

What is claimed is:

1. A silver halide light-sensitive material comprising a support having on one side thereof hydrophilic colloid layers including a silver halide emulsion layer, wherein at least one of the hydrophilic colloid layers contains a dye represented by Formula (1) in the form of a dispersion of solid particles dispersed in a binder,

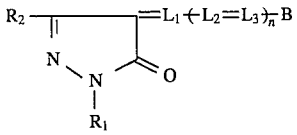

Formula (1)

wherein $R_1$ is hydrogen, alkyl, aryl or heterocyclic; $R_2$ is hydrogen, alkyl, aryl, heterocycle, alkoxycarbonyl, aryloxycarbonyl, carbamoyl, acylamino, ureido, amino, acyl, alkoxy, aryloxy, hydroxy, carboxy, cyano, sulfamoyl, or sulfonamide; B is a five- or six-membered oxygen-containing heterocycle or a six-membered nitrogen-containing heterocycle; $L_1$, $L_2$ and $L_3$ are carbon; n is 0 or 1, provided that the compound represented by Formula (1) contains at least one of carboxy, sulfonamide, and sulfamoyl; and said silver halide emulsion layer containing a polyhydric alcohol wherein the polyhydric alcohol is an aliphatic alcohol having 2 to 20 carbon atoms and 2 to 12 hydroxy groups.

2. The silver halide photographic material of claim 1, wherein said hydrophilic colloid lawyers contains gelatin in a total amount of not more than 3.7 g/m² of photographic material.

3. The silver halide photographic material of claim 1, wherein said polyhydric alcohol has a melting point of 50° to 300° C.

4. The silver halide photographic material of claim 1, wherein said silver halide emulsion layer contains silver halide grains comprising silver bromide, silver iodobromide or silver iodochlorobromide.

* * * * *